US009694622B2

(12) United States Patent
Shea et al.

(10) Patent No.: US 9,694,622 B2
(45) Date of Patent: Jul. 4, 2017

(54) WRITING IMPLEMENT WITH REVERSE CLIP CAP

(71) Applicant: Rotuba Extruders, Inc., Linden, NJ (US)

(72) Inventors: Gregory Shea, Garwood, NJ (US); Colleen Shea, Garwood, NJ (US); Warren Shea, Garwood, NJ (US); Adam Bell, Linden, NJ (US)

(73) Assignee: ROTUBA EXTRUDERS, INC., Linden, NJ (US)

( * ) Notice: Subject to any disclaimer, the term of this patent is extended or adjusted under 35 U.S.C. 154(b) by 0 days.

(21) Appl. No.: 14/589,607

(22) Filed: Jan. 5, 2015

(65) Prior Publication Data

US 2016/0193865 A1 Jul. 7, 2016

(51) Int. Cl.
*B43K 23/12* (2006.01)

(52) U.S. Cl.
CPC ..... *B43K 23/126* (2013.01)

(58) Field of Classification Search
CPC combination set(s) only.
See application file for complete search history.

(56) References Cited

U.S. PATENT DOCUMENTS 1,451,261 A * 4/1923 Jallier ..... B43K 25/024 24/11 P
2,512,031 A * 6/1950 Marcoux ..... B43K 25/022 24/11 M
2,541,669 A * 2/1951 Rosa ..... B43K 25/022 24/11 M
3,567,053 A * 3/1971 Willock ..... B60P 3/41 414/620
5,174,672 A * 12/1992 Towsend ..... B43K 23/08 401/131
5,421,664 A * 6/1995 Okamoto ..... A45D 34/041 401/187
5,427,464 A * 6/1995 Nakagawa ..... B43K 23/124 24/11 F
5,535,487 A * 7/1996 Kageyama ..... B43K 25/024 24/11 F
7,172,359 B2 * 2/2007 Mock ..... B43K 8/022 401/202
8,764,331 B1 7/2014 Lubanski

* cited by examiner

*Primary Examiner* — David Walczak
(74) *Attorney, Agent, or Firm* — Leason Ellis LLP

(57) ABSTRACT

A removable cap for receiving a writing implement includes a reverse clip. The cap has a hollow crown section for receiving the writing implement and an elongate cap extension that extends axially from the hollow crown section and includes an end that terminates in a clip flange. An elongate holding prong projecting substantially perpendicular from the clip flange and extending and opening toward the closed first end of the crown section in substantially parallel-spaced relation to the cap extension so as to define in conjunction with the cap extension and the hollow crown section, an elongate U-shaped slot, which is adapted to snugly engage an attachment material inserted into the slot. A gripping member is located within the U-shaped slot and is configured to intimately engage the attachment material inserted into the slot to assist in maintaining the engagement between the cap and attachment material when the writing implement is removed from the cap.

20 Claims, 6 Drawing Sheets

WRITING IMPLEMENT WITH REVERSE CLIP CAP

TECHNICAL FIELD

The present invention relates to writing implements, such as markers, pencils and pens and more particularly, to a cap that has a reverse clip with a gripping member as a part thereof.

BACKGROUND

As used herein, the term "writing implement" refers to any object that is used to write, including but not limited to, markers, pencils, pens, etc. As used herein, the term "marker" refers to any ink-based writing or marking implement.

Felt-tipped markers are commonly found in the tool belts of carpenters and other craftsmen to mark measurements on building materials. The problem faced by craftsmen in using such markers involves the removal of the cap, which requires the use of both hands—one to remove the cap and the other to hold the writing portion of the marker. This forces the craftsman to either lay down the tool or material that he/she is working with, or use his/her teeth to pull off the cap, thereby risking injury and/or dental damage.

The present invention provides an alternative cap design, which secures the marker/pen in place in a user's pocket or tool pouch (e.g., apron), but allows the user to remove the marker/pen from the cap with one hand.

SUMMARY

The present invention relates to an improved reverse clip cap, in which the clip extends and opens toward the enclosed end of the cap, instead of toward the open end, as in conventional caps. Since the direction of the force applied to the cap to separate the cap from the marker body will always be away from the open end of the cap, a conventional clip which opens toward the open end of the cap will inherently be pulled away from and free of its attachment to a tool belt, pocket or pouch (e.g., apron) when the cap is removed with one hand.

In the reverse clip design of the present invention, on the other hand, the reverse clip opens toward the closed end of the cap, that is, in the same direction as the force applied to remove the cap, thereby allowing the cap to be removed with one hand without dislodging the reverse clip from its attachment.

To facilitate single-handed removal and replacement of the marker, the cap of the present invention has a semi-tubular cap extension, terminating in a flange from which the reverse clip extends. The cap extension acts as a guide for replacing the marker in the cap with one hand, while the flange provides a flat surface against which downward thumb pressure can be applied to separate the cap from the marker as the latter is pulled up with the other fingers of the same hand.

In at least one embodiment of the present invention, the enclosed end of the cap contains an interior tubular channel which protects the marker tip and prevents it from drying out by exposure to ambient air.

In accordance with the present invention, a gripping member (structure) is disposed within a U-shaped slot (formed between the cap extension and the reverse clip) and is configured to intimately engage the attachment material inserted into the slot to maintain the engagement between the cap and attachment material when the writing implement is removed from the cap. The gripping member can be in the form of two sets of barbs (teeth) that face one another and are disposed within the U-shaped slot such that the attachment material is received between the two sets of barbs and is intimately engaged thereby. The gripping member can also be in the form of a cantilever structure that protrudes into the U-shaped slot and is connected to the cap extension and has barbs formed thereon for intimately engaging the attachment material. The cantilever structure is a flexible member that applies a biasing force to the attachment material in a direction toward the holding prong.

The foregoing summarizes the general design features of the present invention. In the following sections, specific embodiments of the present invention will be described in some detail. These specific embodiments are intended to demonstrate the feasibility of implementing the present invention in accordance with the general design features discussed above. Therefore, the detailed descriptions of these embodiments are offered for illustrative and exemplary purposes only, and they are not intended to limit the scope either of the foregoing summary description or of the claims which follow.

BRIEF DESCRIPTION OF THE DRAWING FIGURES

DETAILED DESCRIPTION OF CERTAIN EMBODIMENTS

Figure 1:
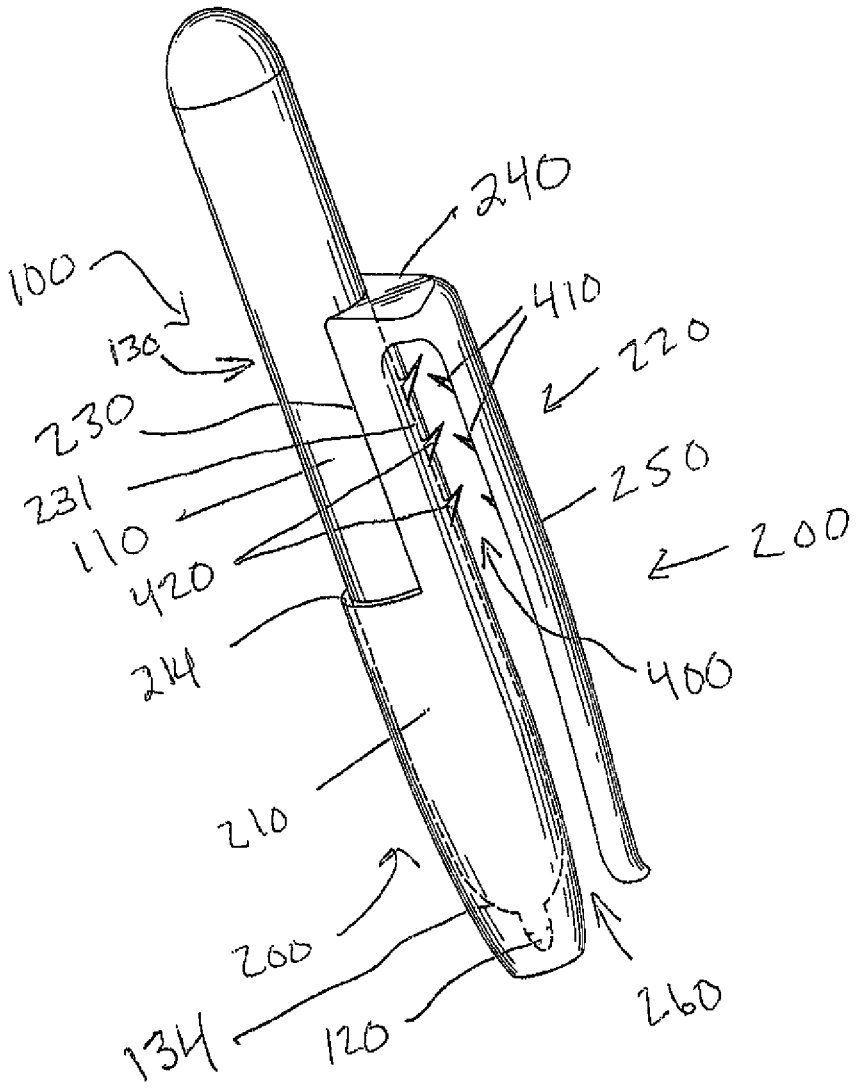
FIG. 1 is a perspective view of a writing implement with a cap in accordance with a first embodiment of the present invention.
Figure 9:
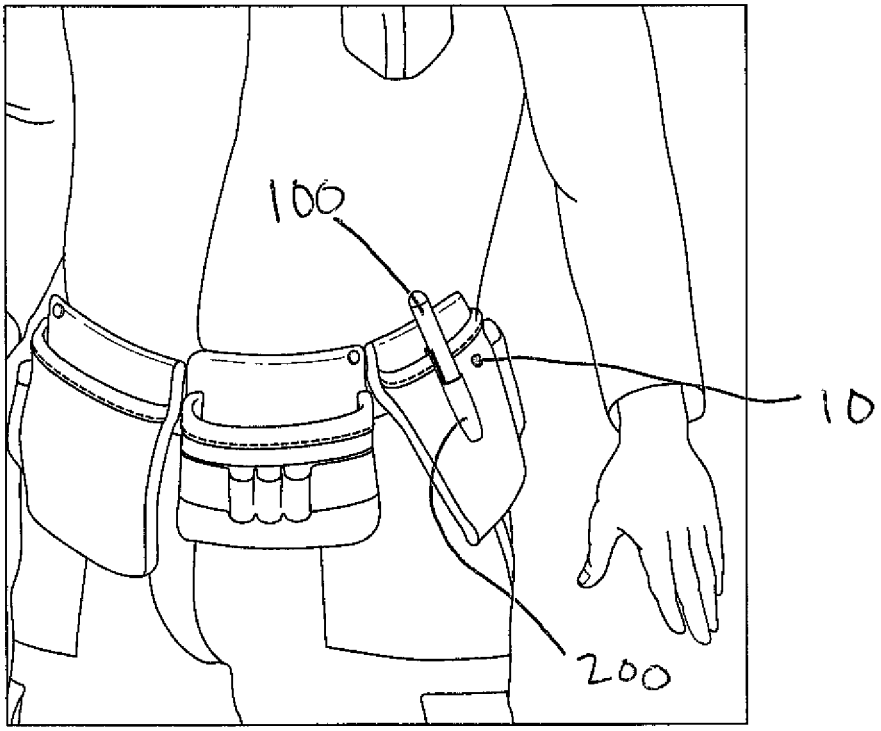
FIG. 9 is a front perspective view of the writing implement and cap of the present invention worn by a user by being securely, yet releasably, attached to an apron of the user.

Referring to FIGS. 1 and 9, a writing implement 100 according to one exemplary embodiment of the present invention includes an elongated body 110 that terminates in a writing tip 120. When the writing implement 100 is in the form of a marker, it includes an ink reservoir 130 and the tip 120 is in the form of a marking tip. The ink reservoir 130 has a distal barrel and a tapered end 134 adjoining the marking tip 120.

The writing implement 100 also includes a removable cap 200 that is defined by a cap body 201. The cap 200 fits over the writing implement 100 and comprises a proximal crown section 210 and a distal clip section 220. The crown section 210 defines an internal crown cavity 212 and has a crown aperture 214, which snugly accepts the tapered end 134 and the marking tip 120 of the writing implement (marker member) 100.

The clip section 220 has a semi-tubular cap extension 230, which projects upward from the crown aperture 214 and terminates in a clip flange 240. Projecting downward from the clip flange 240 is a holding prong 250, in substantially parallel-spaced relation to the cap extension 230, so as to define, in conjunction with the cap extension 230 and the crown section 210, a U-shaped slot 260, which is adapted to snugly engage an attachment material (article) 10 inserted into the slot 260, thereby enabling the cap 200 to be securely attached to a belt, pocket or pouch.

The attachment material 10 can be any number of different articles that allow the writing implement and cap to be suspended from a person's body and the attachment material 10 can be formed of any number of different materials. For example, the attachment material can be a pocket of the user (e.g., a shirt or pant's pocket) or can be an apron that is worn by the user or can be any other material that is part of an article being worn by the user.

In FIG. 9, the attachment material 10 is in the form of layer of fabric of an apron that is being worn by a user. The cap 200 is thus securely attached to the apron.

Figure 3:
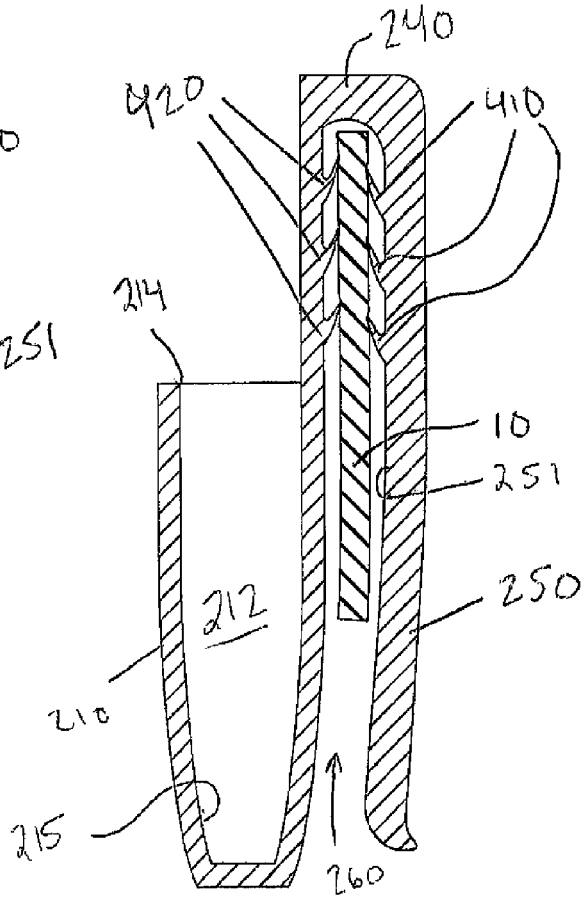
FIG. 3 is a cross-sectional view of the cap of FIG. 1.

Referring to FIG. 3, the enclosed end of the cap 200 contains within the crown cavity 212, a tubular, conical or frusto-conical shaped tip channel 215, which is adapted to receive and enclose the marking tip 120 of the writing implement 100, thereby protecting the marking tip 120 from abrasive damage and from the drying effect of exposure to the air.

With this reverse clip configuration, the writing implement 100 can be removed from the cap 200 by pressing the thumb of one hand downward on the clip flange 240 and, with one or more of the other fingers of the same hand wrapped around the barrel 132 of the writing implement (e.g., marking member), lifting the writing implement 100 out of the cap 200. When replacing the writing implement 100 into the cap 200, the cap extension 230 acts as a guide along which the writing implement 100 can slide into the cap 200.

In accordance with the present invention, the cap 200 includes a gripping member or feature 300 that is configured to enhance the gripping action between the clip 200 and the article 10 (attachment material) that this inserted into the slot 260. When the writing implement 100 is removed from the cap 200, it is desired for the cap 200 to remain fixed to the article 10 (attachment material, such as a pocket or apron material, etc.) when the user applies a force to remove the writing implement 100 from the cap 200. In other words, the cap 200 should remain fixedly attached to the article 10 as the writing implement 100 is pulled upwardly from the cap 100 for disengagement of the writing implement 100 from the cap 200.

Figure 2:
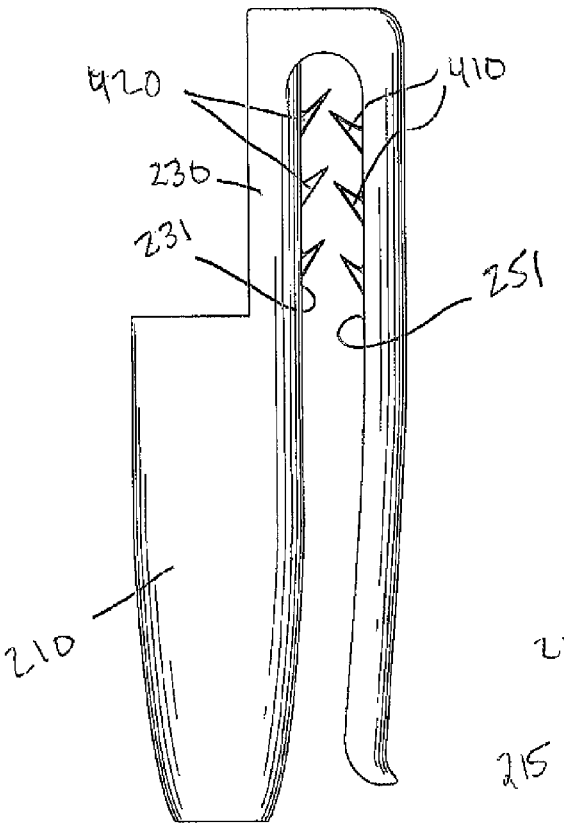
FIG. 2 is a side elevation view of the cap of FIG. 1.
Figure 4:
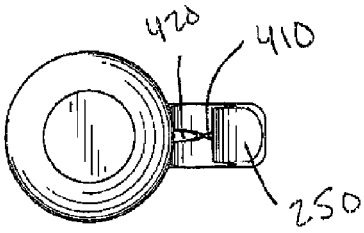
FIG. 4 is a bottom plan view of the cap of FIG. 1.
Figure 5:
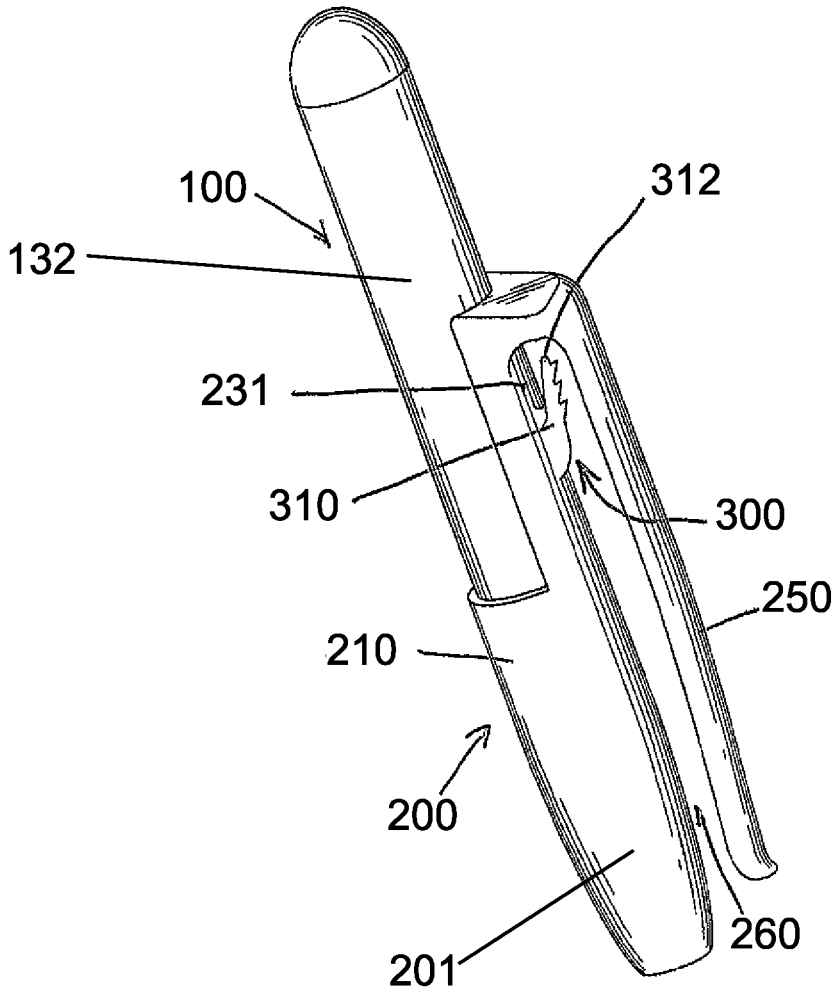
FIG. 5 is a perspective view of a writing implement with a cap in accordance with a second embodiment of the present invention.

FIGS. 2-4 illustrate one embodiment of a gripping member 400. The gripping member 400 comprises two sets of opposing barbs (teeth) that are disposed within the slot 260. More particularly, the gripping member 400 includes a first set of barbs (teeth) 410 and a second set of barbs (teeth) 420. The first set of barbs (teeth) 410 are disposed along an inner surface 251 of the holding prong 250 and the second barbs (teeth) 420 are disposed along the outer surface 231 of the extension 230. The sets of barbs (teeth) 410, 420 are arranged such that the article 10 that is inserted between the two sets of barbs (teeth) 410, 420 and the sharp points of the barbs (teeth) 410, 420 bite into the article to securely attach the cap 200 to the article 10. As shown in FIG. 2, each barb can be in the form of sharp pointed structure.

It will be appreciated that the sets of barb (teeth) 410, 420 can be arranged in different manners relative to one another. For example, the barbs (teeth) 410, 420 can be at least partially staggered as shown or the barbs (teeth) 410, 420 can be directly facing one another. In the illustrated embodiment, each barb 410, 420 is formed at an angle (in this case, each is angled upwardly toward flange 240).

It will be appreciated that the size, shape and number of barbs 410, 420 can vary and the barbs 410, 420 shown in FIGS. 2-4 are only exemplary in nature and not limiting of the scope of the present invention. In addition, the direction at which the barbs 410, 420 protrude from their respective surfaces 310 and the distances they protrude can vary. Further, the barbs 410, 420 can have different physical characteristics relative to one another. For example, the barbs within one set can be uniform or they can be different from one another and/or the barbs of the two sets can be uniform or they can be different from one another.

Since barbs 410 are directly formed with the holding prong 250, the barbs 410 are part of a resilient structure that can flex outwardly when the article 10 is inserted into the slot 260 to permit reception of the article 10. The holding prong 250 thus acts as a biasing member that applies a force to the article 10 in the direction toward the cap extension 230. This biasing force acts as a retention force for retaining the article 10 within the slot 260.

The barbs 410, 420 can be an integral structure with the cap 200. For example, the barbs 410, 420 can be integrally formed with the remaining portions of the cap 200 as by a common molding process.

Figure 6:
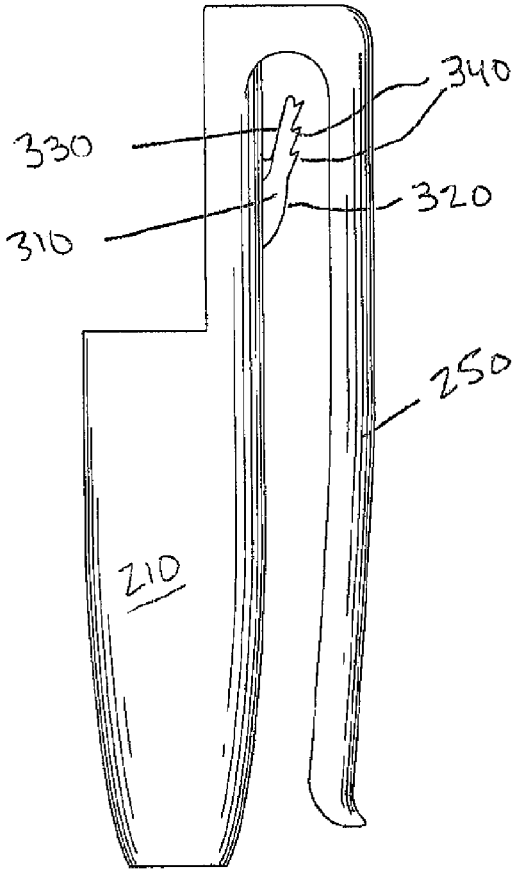
FIG. 6 is a side elevation view of the cap of FIG. 1.
Figure 7:
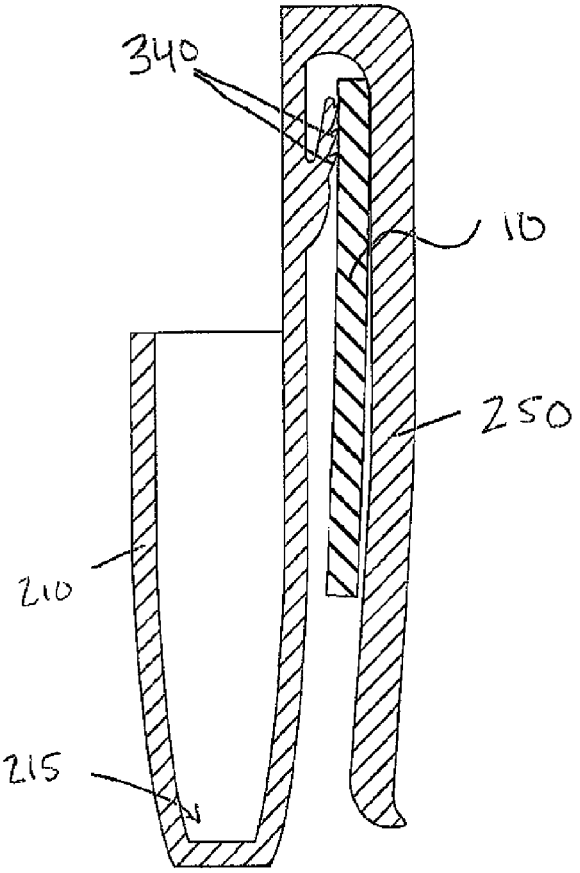
FIG. 7 is a cross-sectional view of the cap of FIG. 1.
Figure 8:
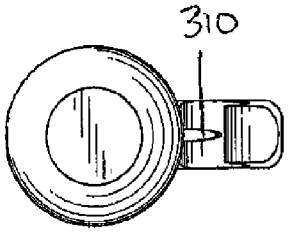
FIG. 8 is a bottom plan view of the cap of FIG. 1.

FIGS. 5-8 illustrate one embodiment of the gripping member 300. The gripping member 300 comprises a cantilever structure 310 that protrudes outwardly from an outer surface 231 of the cap extension 230. The cantilever structure 310 is thus disposed within the slot 260 and is formed so as to extend in a direction toward the clip flange 240. As shown in FIG. 6, a distal end 312 of the cantilever structure 310 can be located proximate to the clip flange 240.

The cantilever structure 310 includes a first face 320 that faces the holding prong 250 and a second face 330 that faces the cap extension 230. The first face 320 includes a plurality of sharp barbs (teeth) 340 that are formed along a length thereof. The barbs 340 are thus located in the space between the cantilever structure 310 and the holding prong 250. Since the cantilever structure 310 is a cantilever and is formed of a resilient material, the cantilever structure 310 can flex. In particular, when object 10 is inserted into the slot 260, the clip 200 is directed downwardly so as to force the object 10 to enter the space between the cantilever structure 10 and the holding prong 250. This causes the object 10 to intimately engage the sharp barbs 340 resulting in a gripping action between the barbs 340 of the cantilever structure 310 and the object 10 resulting in the cap 200 being securely retained on the object 10.

Since the cantilever structure 310 comprises a resilient member, the cantilever structure 310 by nature wants to assume the rest position shown in FIG. 6 and therefore, when object 10 is disposed within the space between the cantilever structure 10 and the holding prong 250, a biasing force is also applied by the cantilever structure 310 against the object 10. The barbs 340 and this biasing force in combination applies the gripping force/action for securely maintaining the coupling between the cap 200 and the object 10 when the user applies a force to disengage the writing implement 100 from the cap 200.

The cantilever structure 310 can be an integral structure with the cap 200. For example, the cantilever structure 310 can be integrally formed with the remaining portions of the cap 200 as by a common molding process.

It will be appreciated that the size, shape and number of barbs 340 can vary and the barbs 340 shown in FIGS. 5-8 are only exemplary in nature and not limiting of the scope of the present invention. In addition, the direction at which the barbs 340 protrude from the cantilever structure 310 and the distances they protrude can vary. Further, the cantilever structure 310 can have barbs 340 that have different physical characteristics relative to one another.

It will be appreciated that the gripping member (feature) is not limited to the structures disclosed herein, which are merely exemplary, but instead can take different forms so long as they can achieve the objective described herein. For example, the gripping member can be in the form of other protrusions, such as bumps, that protrude into the U-shaped slot or can be in the form of a roughened surface that is part of the outer face of the cap extension and/or an inner face of the holding prong. For example, the surface can have a sandpaper-like feel for intimately contacting and engaging the attachment material 10. In addition, a material can be applied to the gripping member to assist in the gripping action. For example, an adhesive material or other tacky material (such as rubber) or the like can be applied to a face of the gripping member. For example, a tacky material can be applied to the gripping member for contacting the attachment material 10. The tacky material can be in the form of a pad that can be inserted into a slot formed in the gripping member (e.g., a cantilever structure with or without barbs). Other materials and structures can be used as well.

Figure 10:
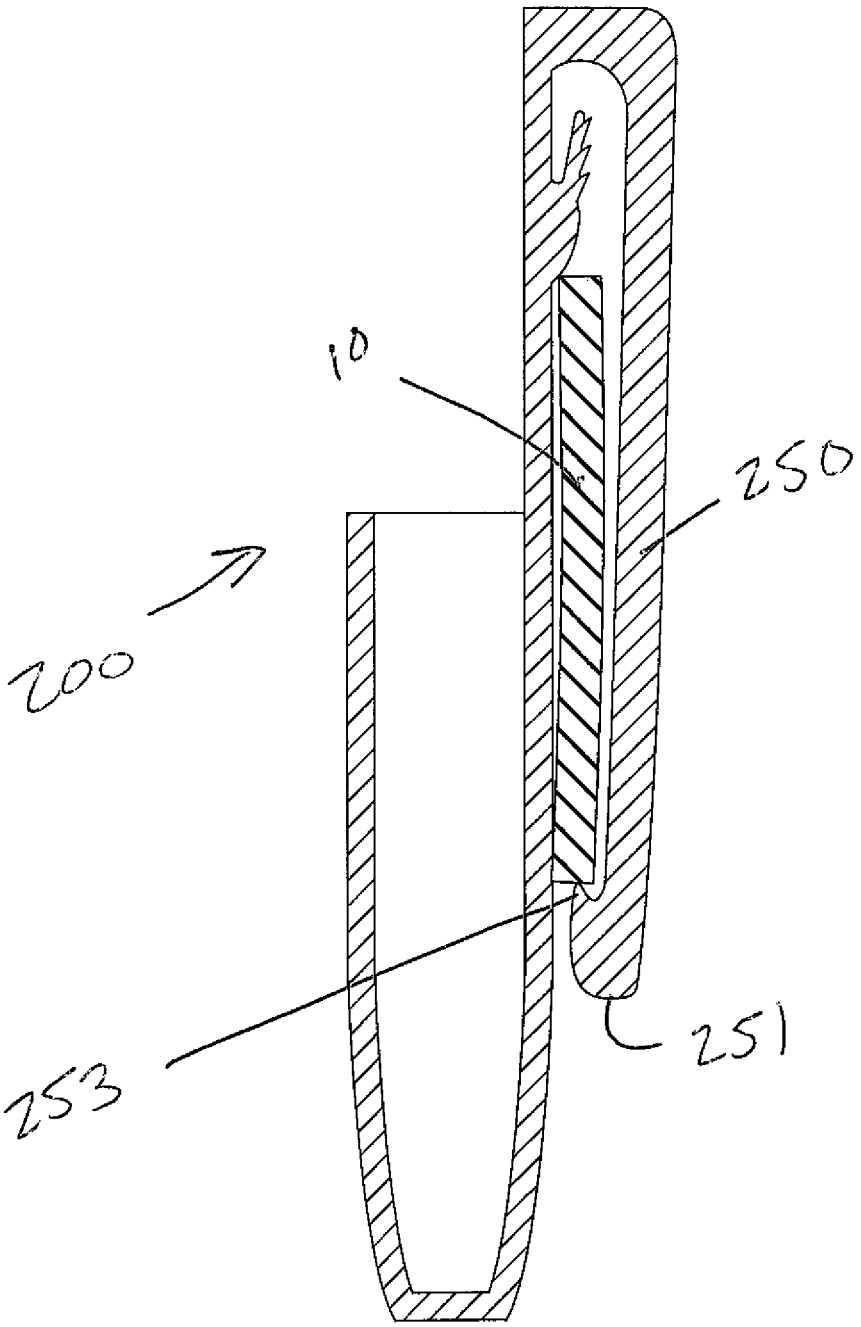
FIG. 10 is a cross-sectional view of another exemplary cap in accordance with the present invention.

FIG. 10 shows another feature that can be incorporated into any of the caps disclosed herein. In particular, a free end 251 of the holding prong 250 can include an integral hook 253 (protrusion) that protrudes into the U-shaped slot and is configured to catch and contain a bottom edge of a belt (attachment material 10) when the cap 200 is worn on a belt. Since the holding prong 250 is a resilient structure, the hook 253 will engage the bottom edge of the belt and extend thereacross so as to restrict and prevent free upward movement of the cap 200 relative to the belt. It will be appreciated that the hook 253 can be included in any of the caps 200 disclosed herein and thus, the cap 200 can have one of the disclosed gripping member and the hook 253. Alternatively, the hook 253 can be eliminated.

Although the preferred embodiment of the present invention has been disclosed for illustrative purposes, those skilled in the art will appreciate that many additions, modifications and substitutions are possible, without departing from the scope and spirit of the present invention as defined by the accompanying claims.

What is claimed is:

1. A removable cap for use with a writing implement comprising:

a body having an enclosed proximal end and an open distal end and is configured to fit over the writing implement, the body including a proximal crown section and a distal clip section, wherein the proximal crown section defines an internal crown cavity configured to snugly receive a tip of the writing implement, wherein the distal clip section includes an elongated extension which extends axially from the proximal crown section and includes a distal end which terminates in a clip flange, the distal clip section further comprising an elongate holding prong projecting substantially perpendicular from the clip flange and extending toward the enclosed proximal end of the cap in substantially parallel-spaced relation to the cap extension so as to define in conjunction with the cap extension and the proximal crown section, an elongate U-shaped slot, which is adapted to snugly engage an attachment material inserted into the slot; and a gripping member that is located within the U-shaped slot and is configured to intimately engage the attachment material inserted into the slot to assist in maintaining the engagement between the cap and attachment material when the writing implement is removed from the cap wherein the gripping member comprises a first set of barbs formed on an inner surface of the holding prong facing the cap extension and a second set of barbs formed along an outer surface of the cap extension facing the holding prong and the first set of barbs, whereby both the first and second set of barbs are disposed in the U-shaped slot, the first and second set of barbs being oriented and sized so as to be free of contact with one another in a rest position prior to insertion of the attachment material.

2. The removable cap of claim 1, wherein the first and second barbs are staggered relative to one another.

3. The removable cap of claim 1, wherein each barb comprises a sharp pointed structure that projects into the U-shaped slot at an angle.

4. The removable cap of claim 1, wherein the holding prong is a flexible structure and therefore, the first set of barbs flex with the holding prong.

5. The removable cap of claim 4, wherein the holding prong is adapted to applying a biasing force to the attachment material.

6. A removable cap for use with a writing implement comprising:

a body having an enclosed proximal end and an open distal end and is configured to fit over the writing implement, the body including a proximal crown section and a distal clip section, wherein the proximal crown section defines an internal crown cavity configured to snugly receive a tip of the writing implement, wherein the distal clip section includes an elongated extension which extends axially from the proximal crown section and includes a distal end which terminates in a clip flange, the distal clip section further comprising an elongate holding prong projecting substantially perpendicular from the clip flange and extending toward the enclosed proximal end of the cap in substantially parallel-spaced relation to the cap extension so as to define in conjunction with the cap extension and the proximal crown section, an elongate U-shaped slot, which is adapted to snugly engage an attachment material inserted into the slot; and a gripping member that is located within the U-shaped slot and is configured to intimately engage the attachment material inserted into the slot to assist in maintaining the engagement between the cap and attachment material when the writing implement is removed from the cap; wherein the gripping member comprises a cantilever structure that projects outwardly from an outer surface of the cap extension into the U-shaped slot, the cantilever structure being an elongated structure that is attached at a proximal end portion thereof and terminates in a free distal end portion, the elongated structure containing barbs that are disposed between the proximal and distal end portions and that face the holding prong.

7. The removable cap of claim 6, wherein the cantilever structure projects within the U-shaped slot towards the clip flange.

8. The removable cap of claim 6, wherein the cantilever structure comprise a flexible structure that is adapted to apply a biasing force to the attachment material.

9. The removable cap of claim 6, wherein a free end of the cantilever structure is proximate the clip flange.

10. The removable cap of claim 1, wherein a free end of the holding prong is proximate the closed first end of the crown section.

11. A removable cap for use with a writing implement comprising:

a body having an enclosed proximal end and an open distal end and is configured to fit over the writing implement, the body including a proximal crown section and a distal clip section, wherein the proximal crown section defines an internal crown cavity configured to snugly receive a tip of the writing implement, wherein the distal clip section includes an elongated extension which extends axially from the proximal crown section and includes a distal end which terminates in a clip flange, the distal clip section further comprising an elongate holding prong projecting substantially perpendicular from the clip flange and extending toward the enclosed proximal end of the cap in substantially parallel-spaced relation to the cap extension so as to define in conjunction with the cap extension and the proximal crown section, an elongate U-shaped slot, which is adapted to snugly engage an attachment material inserted into the slot; and a gripping member that is located within the U-shaped slot and is configured to intimately engage the attachment material inserted into the slot to assist in maintaining the engagement between the cap and attachment material when the writing implement is removed from the cap;

wherein the gripping member comprises a cantilever structure that projects outwardly from an outer surface of the cap extension into the U-shaped slot, the cantilever structure being integrally formed and fixedly attached to an outer surface of the cap extension.

12. The removable cap of claim 11, wherein the cantilever structure comprise a flexible structure that is adapted to apply a biasing force to the attachment material.

13. The removable cap of claim 11, wherein a free end of the cantilever structure is proximate the clip flange.

14. The device of claim 11, wherein a longitudinal axis that extends along a length of the cantilever structure intersects the clip flange.

15. A removable cap for use with a writing implement comprising: a body having an enclosed proximal end and an open distal end and is configured to fit over the writing implement, the body including a proximal crown section and a distal clip section, wherein the proximal crown section defines an internal crown cavity configured to snugly receive a tip of the writing implement, wherein the distal clip section includes an elongated extension which extends axially from the proximal crown section and includes a distal end which terminates in a clip flange, the distal clip section further comprising an elongate holding prong projecting substantially perpendicular from the clip flange and extending toward the enclosed proximal end of the cap in substantially parallel-spaced relation to the cap extension so as to define in conjunction with the cap extension and the proximal crown section, an elongate U-shaped slot, wherein a free end of the holding prong includes an integral hook that protrudes inwardly toward the proximal crown section and a first space is defined within the U-shaped slot between a tip of the integral hook and the clip flange, the first space being configured to receive attachment material which is securely retained within the U-shaped slot between the integral hook and the clip flange.

16. The removable cap of claim 15, wherein the tip of the integral hook is pointed in a direction toward the clip flange.

17. The removable cap of claim 15, further including a gripping member that is located within the U-shaped slot, wherein the gripping member comprises a cantilever structure that projects outwardly from an outer surface of the cap extension at a first location into the U-shaped slot, the cantilever structure being integrally formed and fixedly attached to an outer surface of the cap extension.

18. The removable cap of claim 17, wherein a distance between the cantilever structure and the tip of the integral hook is sized to receive the attachment material which comprises a belt with a top edge of the belt for placement adjacent the cantilever structure and a bottom edge of the belt for placement in engagement with the top of the integral hook.

19. A method for securely attaching a removable cap, that is for use with a writing implement, to a belt and maintaining engagement between the removable cap and the belt when the writing implement is removed from the belt, the removable cap including a body having an enclosed proximal end and an open distal end and is configured to fit over the writing implement, the body including a proximal crown section and a distal clip section, wherein the proximal crown section defines an internal crown cavity configured to snugly receive a tip of the writing implement, wherein the distal clip section includes an elongated extension which extends axially from the proximal crown section and includes a distal end which terminates in a clip flange, the distal clip section further comprising an elongate holding prong projecting substantially perpendicular from the clip flange and extending toward the enclosed proximal end of the cap in substantially parallel-spaced relation to the cap extension so as to define in conjunction with the cap extension and the proximal crown section, an elongate U-shaped slot, the method comprising the step of:

inserting the belt into the elongated U-shaped slot; and engaging an integral hook to a bottom edge of the belt so as to securely attach the removable cap to the belt and maintain the removable cap in engagement with the belt when the writing implement is removed from the removable cap, the integral hook being formed at a free end of the holding prong and protruding inwardly toward the proximal crown section.

20. The method of claim 19, wherein the integral hook includes a pointed tip that is pointed in a direction toward the clip flange, the pointed tip engaging the bottom edge of the belt.

* * * * *